US010421109B2

(12) United States Patent
Murai et al.

(10) Patent No.: US 10,421,109 B2
(45) Date of Patent: Sep. 24, 2019

(54) STEP-BENDING DIE DEVICE

(71) Applicant: FLIGHT CORPORATION, Kanagawa (JP)

(72) Inventors: Nobutaka Murai, Kanagawa (JP); Shoichi Murai, Kanagawa (JP)

(73) Assignee: FLIGHT CORPORATION, Kanagawa (JP)

( * ) Notice: Subject to any disclaimer, the term of this patent is extended or adjusted under 35 U.S.C. 154(b) by 267 days.

(21) Appl. No.: 15/516,744

(22) PCT Filed: Nov. 2, 2016

(86) PCT No.: PCT/JP2016/082541
§ 371 (c)(1),
(2) Date: Apr. 4, 2017

(87) PCT Pub. No.: WO2018/083748
PCT Pub. Date: May 11, 2018

(65) Prior Publication Data

US 2018/0264532 A1 Sep. 20, 2018

(51) Int. Cl.
*B21D 5/04* (2006.01)
*B21D 5/01* (2006.01)

(52) U.S. Cl.
CPC ..... *B21D 5/01* (2013.01)

(58) Field of Classification Search
CPC . B21D 5/042; B21D 5/01; B21D 5/04; B21D 5/045

(Continued)

(56) References Cited

U.S. PATENT DOCUMENTS 4,592,518 A * 6/1986 Chubb ..... B21D 5/042 242/129
5,341,669 A * 8/1994 Katz ..... B21D 5/0209 72/313

(Continued)

FOREIGN PATENT DOCUMENTS

JP 02108419 A * 4/1990 ..... B21D 5/01
JP 05317972 A * 12/1993 ..... B21D 5/01

OTHER PUBLICATIONS

Ochiai, 1990, JP 02108419 Translation.*
Mitsuyoshi, 1993, JP 05317972 Translation.*

*Primary Examiner* — Shelley M Self
*Assistant Examiner* — Bobby Yeonjin Kim
(74) *Attorney, Agent, or Firm* — Wenderoth, Lind & Ponack, L.L.P.

(57) ABSTRACT

In a step-bending die device, the die has a horizontal surface and an inclined surface, forming a semicircular groove with a semicircular cross section along a longitudinal direction on the horizontal surface and installing a semicircular rotary blade rotatably in the semicircular groove. The punch has a horizontal surface and an inclined surface, forming a semicircular groove with a semicircular cross section in a longitudinal direction on the horizontal surface and installing a semicircular rotary blade rotatably in the semicircular groove. Vertical notches at positions changing from the horizontal surfaces to the inclined surfaces are formed in longitudinal directions in the die and the punch so that top portions of the die and the punch are formed. The punch is assembled so that the horizontal surface of the punch faces the inclined surface of the die, and the inclined surface of the punch faces the horizontal surface of the die.

16 Claims, 7 Drawing Sheets

(58) Field of Classification Search
USPC ..... 72/380, 387
See application file for complete search history.

(56) References Cited

U.S. PATENT DOCUMENTS

| | | | | | |
|---|---|---|---|---|---|
| 5,365,766 | A * | 11/1994 | Takahashi | B21D 5/0209 | 72/387 |
| 5,746,082 | A * | 5/1998 | Matsuoka | B21D 19/086 | 72/313 |
| 6,672,127 | B2 * | 1/2004 | Maida | B21D 5/0209 | 72/387 |
| 6,959,573 | B2 * | 11/2005 | Matsumoto | B21D 5/02 | 72/31.1 |
| 7,454,943 | B2 * | 11/2008 | Jacobsen | B21D 5/0209 | 72/383 |
| 8,695,394 | B2 * | 4/2014 | Makino | B21D 5/0209 | 72/313 |
| 2003/0154759 | A1 * | 8/2003 | Kobayashi | B21D 5/04 | 72/306 |
| 2011/0265546 | A1 * | 11/2011 | Wilson | B21D 37/06 | 72/387 |
| 2016/0114381 | A1 * | 4/2016 | Ciocirlan | B21J 13/085 | 72/441 |

* cited by examiner

STEP-BENDING DIE DEVICE

TECHNICAL FIELD

The present invention relates to a step-bending die device used in a step-bending.

BACKGROUND OF THE TECHNOLOGY

The shape of the step-bending die is a complicated shape compared with a usual V bending die. The step-bending die is a special die individually designed so as to be adapted to product's shape and thickness. Namely, it was as shown in prior art FIGS. 4 and 5 in Japanese Published Unexamined Patent Application No. H0S-317972 A.

The step-bending die shown in FIG. 4 of the above-mentioned Patent Application is a fixed type for obtained step sizes, and FIG. 5 shows constitution which can vary the step sizes in order to obtain the step size by varying the number of spacers controlling position of an upper block and a lower block.

Problem to be Solved by the Invention

However, in the above both prior examples, though a workpiece is put on a die and pressed from above by a punch at step-bending of the workpiece, there has been a problem that product value of the workpiece has been lost because of scratch on the workpiece arisen by that the workpiece is hit on an edge of the die in the process in which the workpiece is deformed plastically by the step-bending die.

Though the constitution that step. sizes can be varied was achieved in JP H0S-317972 A, the inconvenience that the workpiece is scratched during processing remained unresolved.

SUMMARY OF THE INVENTION

Therefore, an object of the present invention is to prevent process damage on the workpiece during step-bending. Namely, the present invention is to arrange semicircular rotary blades on a die and a punch respectively for step-bending so as to keep full contact of the die and the punch to the workpiece until the step-bending is completed in order to prevent edge contact of the die and the punch to the workpiece and to prevent process scratch occurrence.

Means for Solving the Problems

A step-bending die device according to the present invention is a step-bending die device which is interposed between a die and a punch and which forms steps on a workpiece by changing relative position of the die and the punch, characterized in that: the die is to be constituted by having a horizontal surface and an inclined surface, forming a semicircular groove with a semicircular cross section along a longitudinal direction on the horizontal surface and installing a semicircular rotary blade rotatably in the semicircular groove, that the punch is to be constituted by having a horizontal surface and an inclined surface, forming a semicircular groove with a semicircular cross section in the longitudinal direction on the horizontal surface and installing a semicircular rotary blade rotatably in the semicircular groove, that vertical notches being at positions changing from the horizontal surfaces to the inclined surfaces and communicating with the semicircular grooves are formed in longitudinal directions in the die and the punch, so that top portions of the die and the punch are formed in the longitudinal directions, respectively, and that the punch is assembled to a press brake as point symmetry with respect to the die so that the horizontal surface of the punch faces the inclined surface of the die and the inclined surface of the punch faces the horizontal surface of the die.

As a result, during the entire process from the start to the end of the step-bending process, the semicircular rotary blades constituting the horizontal surfaces of the die and the punch rotate following the bending deformation of the workpiece, so that the edge contact of them is prevented and occurrence of processing scratch is prevented. Besides, because the both semicircular rotary blades rotate in the semicircular grooves respectively, a flat surface of the die's semicircular rotary blade and a flat surface of the punch's semicircular rotary blade are always maintained in parallel. Thus, parallel processing of the left piece and the right piece of the workpiece interposing the step portion of the workpiece can be obtained.

It is characterized that the die and the punch change the interval between vertical lines along vertical portions of said vertical notches formed in both of the die and the punch by changing left-right direction's relative position of them.

As this concrete constitution, it is characterized that an adjuster plate is fixed to the punch with a screw in order to regulate the position in the left-right direction, the workpiece or the shim is interposed between the adjuster plate and the die in the step-bending process, and then the position in the left and right direction of the die is fixed to a die base. Thus, available gap size between top portions that the die and the punch cross (between the vertical lines along both vertical portions of both vertical notches formed in the die and the punch) can be obtained. Furthermore, vertical lines along the vertical portions of the vertical notches are on the same line, and when the workpiece is interposed between the die and the adjuster plate, the vertical lines is adjusted to both vertical line's gap of size equal to thickness of the workpiece. Thus, thickness of step-bending portion becomes available and step-bending processing can be performed without insufficient strength.

It is characterized that tension springs for holding the semicircular rotary blades for installing the both semicircular rotary blades in the both semicircular grooves respectively. Thus, the semicircular rotary blades can be installed rotatably in the semicircular groove by the tension springs respectively.

Moreover, it is characterized that tension return springs for returning the both semicircular rotary blades in one direction respectively. Thus, the semicircular rotary blades can be brought into tight contact with the workpiece during the entire processing steps.

Further, it is characterized that the step size is determined by the amount of change in the relative position in the vertical direction between the die and the punch. Thus, the step size proportional to the stroke amount of the press brake can be obtained.

Effect of the Invention

According to the present invention, because the semicircular rotary blades constituting the horizontal surfaces of the die and the punch rotate following the bending deformation of the workpiece to make planar contact with the workpiece in the entire process from the start to the end of the step-bending process, It is possible to prevent the edge contact and to have an effect of preventing the occurrence of processing scratches.

Besides, since each of the semicircular rotary blades rotates at the same rotation angle during the step bending process, the left piece and the right piece of the workpiece that the semicircular rotary blade are brought into contact are bent at an equal angle across the step portion, and there is an effect that the left piece and the right piece are maintained in parallel.

The die and the punch change the relative position in the left and right direction to change a gap between the vertical lines along the vertical portions of the vertical notches formed in both of the die and the punch. As a specific configuration thereof, the adjuster plate is fixed to the punch by screws, and the position of the die in the left and the right direction is regulated by the adjuster plate. During the step bending process, the workpiece or shim is interposed between the adjuster plate and the die, and an appropriate gap size between vertical lines along both vertical portions of both vertical notches between the die and the punch intersects is obtained. Thus, the thickness of the step bending portion (stepped portion) is appropriately set (thickness equivalent to the workpiece), and step bending processing without strength shortage can be performed.

The semicircular rotary blades can be rotatably installed in the semicircular grooves by the tension springs for holding the semicircular rotating blades.

Further, by the tension return spring for returning the both semicircular rotating blades in one direction, the semicircular rotating blades can be brought into tight contact with the workpiece during the entire processing step.

Furthermore, the step size can be obtained as compared with the amount of change in the relative position in the vertical direction between the die and the punch, and the step size can be obtained easily and availably by appropriately controlling the stroke amount of the press brake.

MODE FOR CARRYING OUT THE INVENTION

Figure 1:
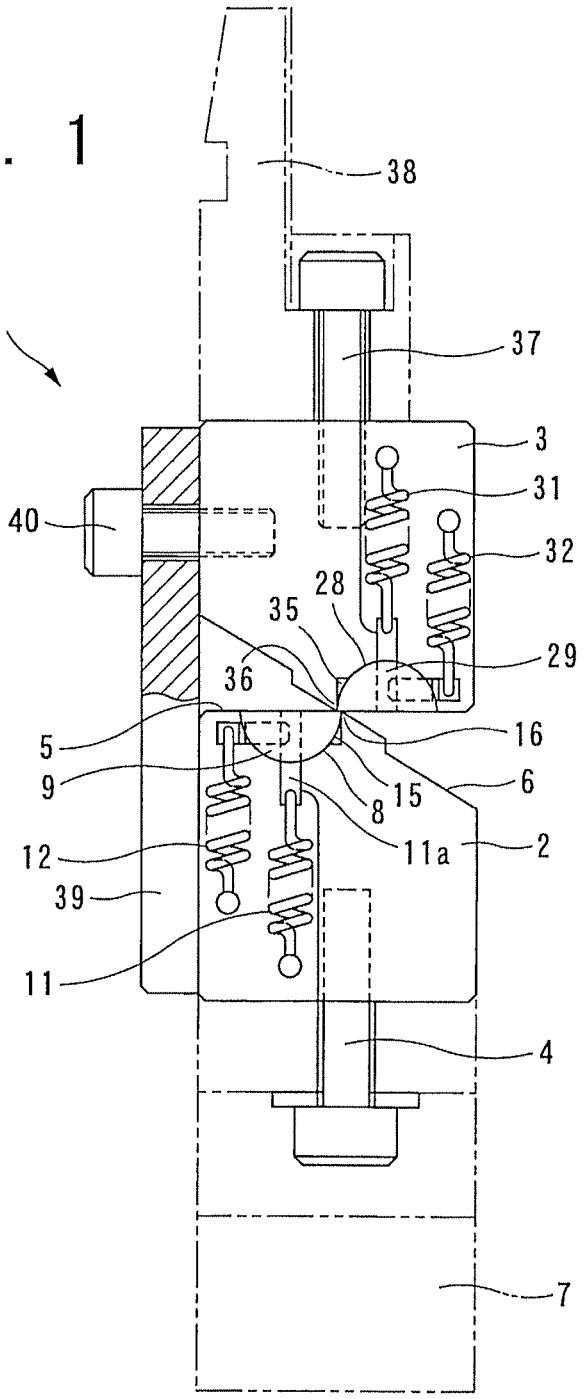
FIG. 1 is a schematic configuration diagram of the present invention.
Figure 2:
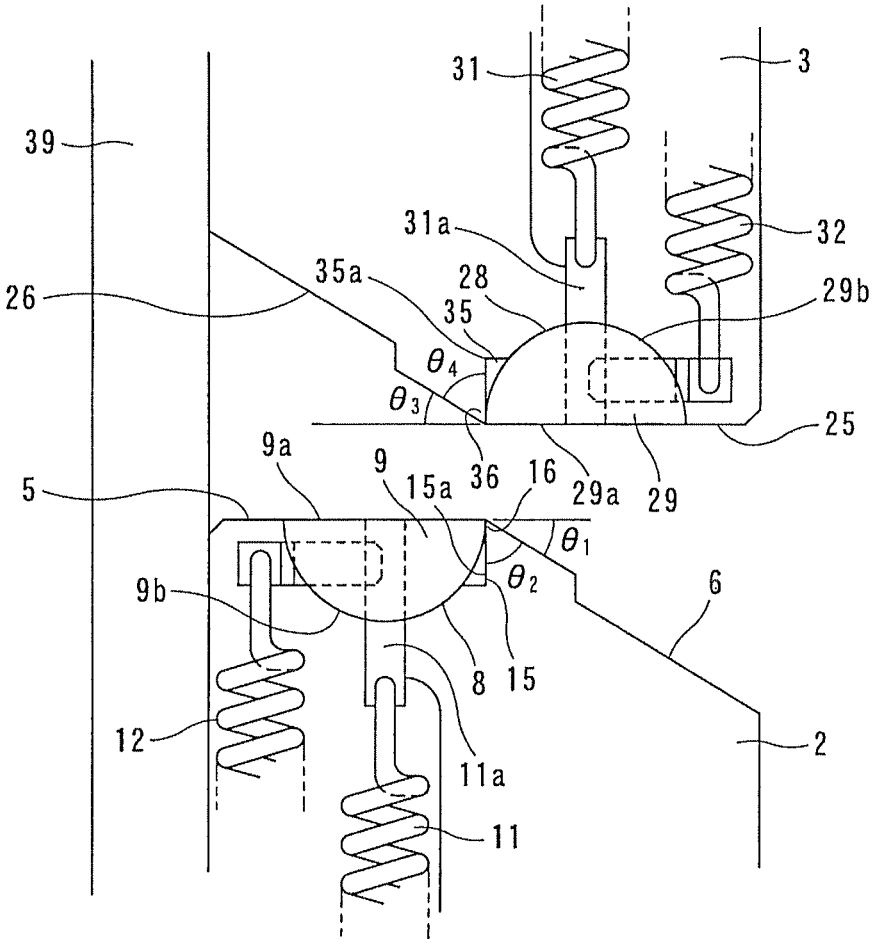
FIG. 2 is an enlarged view of the main part of the same.
Figure 3:
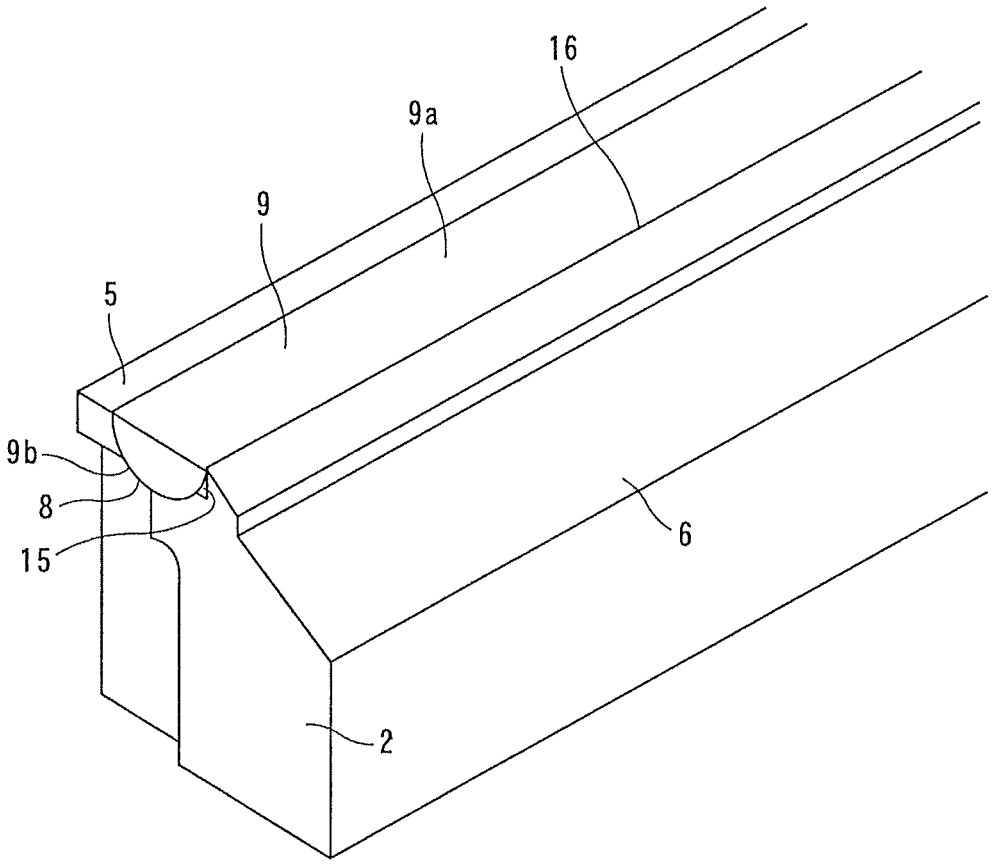
FIG. 3 is a perspective view of the die.
Figure 4:
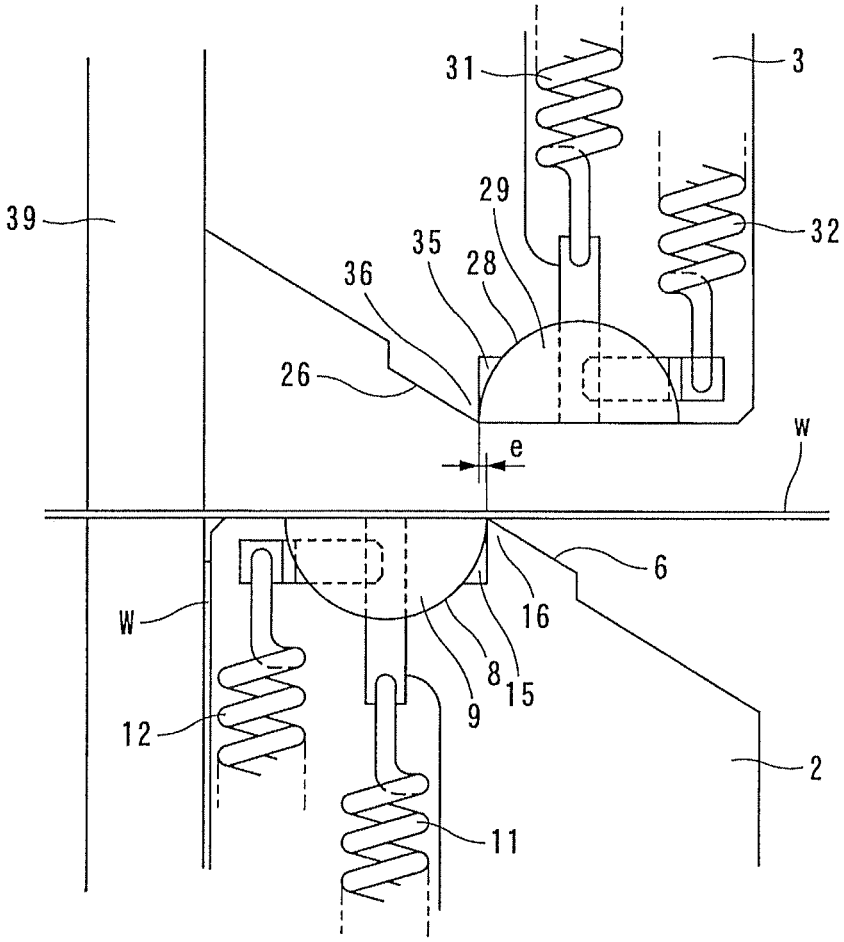
FIG. 4 is a view showing a step-bending process (a first stage)

FIG. 1 to 3 show a step-bending die device according to the present invention, which is attached to a press brake or the like (not shown). This step-bending die device 1 is composed of a die 2 and a punch 3 having a symmetrical structure in the up and down direction. Referring to the die 2 firstly, as shown in FIG. 3, the die 2 has a rectangular parallelepiped shape extending in the lateral direction and has a horizontal surface 5 and an inclined surface 6 on the upper surface thereof, and the horizontal surface and the inclined surface are divided at the center in the short-side direction and extended in the longitudinal direction thereof. This die 2 is fixed to the die base 7 with a fixing bolt 4, but the die 2 can be moved in the horizontal direction (the left and the right direction) when the fixing bolt 4 is loosened.

A semicircular groove 8 with a semicircular cross section is formed in the longitudinal direction on the horizontal surface 5, and a semicircular rotary blade 9 with a semicircular cross section is installed in the semicircular groove 8. Needless to say, the semicircular rotary blade 9 has a horizontally long shape like the semicircular groove 8 and is composed of a flat surface 9*a* and a circular arc surface 9*b*. The circular arc surface 9*b* faces the semicircular groove 8 and makes surface contact with it so that the semicircular rotary blade 9 is rotatable because of the same shape.

When the flat surface 9*a* of the semicircular rotary blade 9 becomes flush in the semicircular groove 8, the horizontal surface 5 becomes flush. This semicircular rotary blade 9 is supported by a tension spring 11 for holding semicircular rotary blade in order to keep an installation state in the semicircular groove 8, and is biased by a rotation returning tension spring 12 giving rotation force in the counterclockwise direction. Besides, the mounting bolt 11*a* of the tension spring for holding the semicircular rotary blade 11 comes into contact with a wall portion of the die 2 and is a counterclockwise rotation stopper. This contact position makes the flat surface 9*a* of the semicircular rotary blade 9 horizontal and the horizontal surface 5 becomes flush.

The inclined surface 6 extends from the horizontal surface 5 at an appropriate angle θ1, for example, at about 30 degrees, and has two steps made by providing a step in the middle thereof.

Besides, a vertical notch 15 that communicates with the inside of the semicircular groove 8 and is vertically cut is formed at a position changing from horizontal surface 5 to the incline surface 6. Namely, the vertical notch 15 is formed on the right side of the semicircular groove 8 on the drawing, whereby a top portion 16 extending in the longitudinal direction is formed at a position changing from the horizontal surface 5 to the incline surface 6. The top portion 16 is responsible for pressing the workpiece W during the step bending process. In the top portion 16, angle θ2 formed by the vertical portion 15*a* of the vertical notch 15 and the inclined surface 6 is at about 60 degrees.

Next, explaining the punch 3, the punch 3 has the same structure as the die 2. Namely, The punch 3 has a rectangular parallelepiped shape which is long in the lateral direction and has a horizontal surface 25 and an inclined surface 26 on the lower surface. The punch 3 is attached via a fixing bolt 37 and a clamp 38 and assembled so that the horizontal surface 25 faces the inclined surface 6 of the die 2 and the inclined surface 6 faces the horizontal surface 5 of the die 2. A semicircular groove 28 is formed on the horizontal surface 25, a semicircular rotary blade 29 with a semicircular cross section is installed in the semicircular groove 28. Needless to say, the semicircular rotary blade 29 has a horizontally long shape like the semicircular groove 28 and is composed of a flat surface 29*a* and an arcuate surface 29*b*. The arcuate surface 29*b* faces the semicircular groove 28 and comes in surface contact with the semicircular groove 28, so that the semicircular rotary blade 29 become rotatable.

The semicircular rotary blade 29 is supported by a tension spring 31 for holding the semicircular rotary blade in order to keep it in the semicircular groove 28 (because it does not fall), and biased by a rotation return tension spring 32 giving rotation force in the. counterclockwise direction. Besides, an attachment bolt 31*a* of the tension spring 31 for holding semicircular rotary blade abuts the wall portion of the punch 3 and serves as a rotation stopper in the counterclockwise direction. This position makes a flat surface 29*a* to the semicircular rotary blade 29 horizontal and makes the horizontal surface 25 flush.

The inclined surface 26 extends from the horizontal surface 25 at an appropriate angle θ3, for example, at about 30 degrees, and has two steps made by providing a step in the middle thereof.

Besides, a vertical notch 35 that communicates with the inside of the semicircular groove 28 and is vertically cut is formed at a position changing from horizontal surface 25 to the incline surface 26. Namely, the vertical notch 35 is formed on the left side of the semicircular groove 28 on the drawing, whereby a top portion 36 extending in the longitudinal direction is formed at a position changing from the horizontal surface 25 to the incline surface 26. The top portion 36 is responsible for pressing the workpiece W during the step bending process.

In the top portion 36, angle θ4 formed by the vertical portion 35*a* of the vertical notch 35 and the inclined surface 26 is at about 60 degrees. Besides, a vertical line along the vertical portion 35*a* of the vertical notch 35 is on the same line as the vertical line along the vertical portion 15*a* of the vertical notch 15 formed in the die 2, and when the workpiece is imposed between the adjuster plate 39 fixed to the punch 3 and the die 2, the vertical lines are adjusted to both vertical line's gap with a size equal to the thickness of the workpiece.

Figure 5:
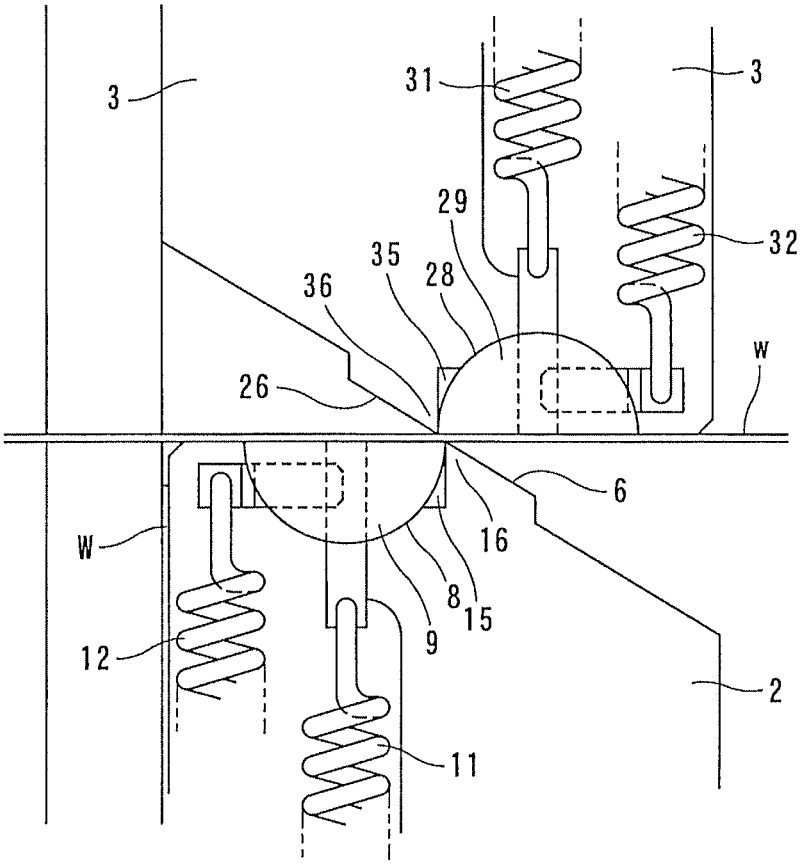
FIG. 5 is a view showing a step-bending process (a second stage)

Next, the step bending process is explained with reference to FIGS. 4 to 7. FIG. 5 shows that: the die 2 and the punch 3 are apart and the workpiece W or the shim is interposed between the die 2 and the adjuster plate 39, and then the die 2 is fixed to the die base 7 with a fixing bolt 4. Then, the die 2 is moved in the left and the right direction thereof, and the thickness dimension e of the workpiece can be obtained between the top portion 16 of the die 2 and the top portion 36 of the punch 3 (between the vertical portion 15*a* and the vertical portion 35*a*). Namely, though the die 2 is moved in order to create the relative position of the die 2 and the punch 3, it is possible to move the punch 3 reversely to obtain the same result.

FIG. 5 shows that the punch 3 is lowered after placing the workpiece Won the die 2. The top portion 36 of the punch 3 is in contact with atop surface of the workpiece W. At this time, the semicircular rotary blade 9 on the horizontal surface 5 of the die 2 also comes in contact with the lower left side of the workpiece W, and the top portion 16 of the die 2. also comes in contact with the flat surface of the workpiece W. In addition, the semicircular rotary blade 29 on the horizontal surface 25 of the punch 3 makes contact with the upper right side of the workpiece W for the first time.

Figure 6:
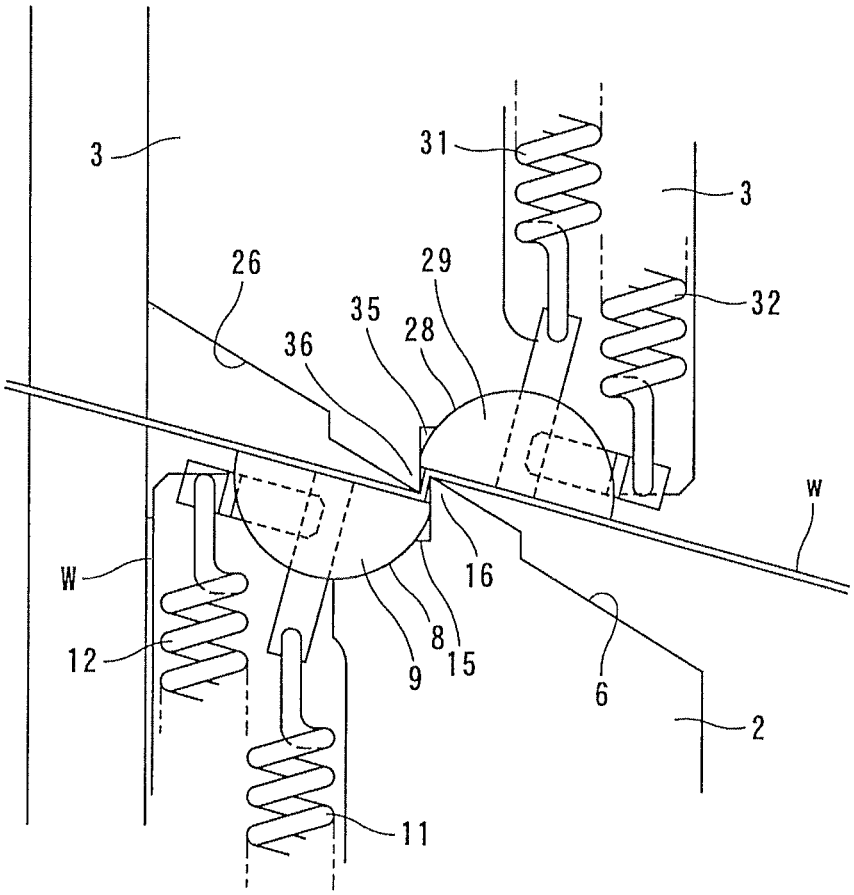
FIG. 6 is a view showing a step-bending process (a third stage)

FIG. 6 shows that: when the punch 3 is lowered further from the state shown in FIG. 5, the top portion 16 of the die 2 presses the workpiece W from below, and the top portion 36 of the punch 3 presses the workpiece W from above. Then, the top portion 16 enters the vertical notch 35 while bending the workpiece W, and at the same time, the top portion 36 enters the vertical notch 15 while bending the workpiece W.

Figure 7:
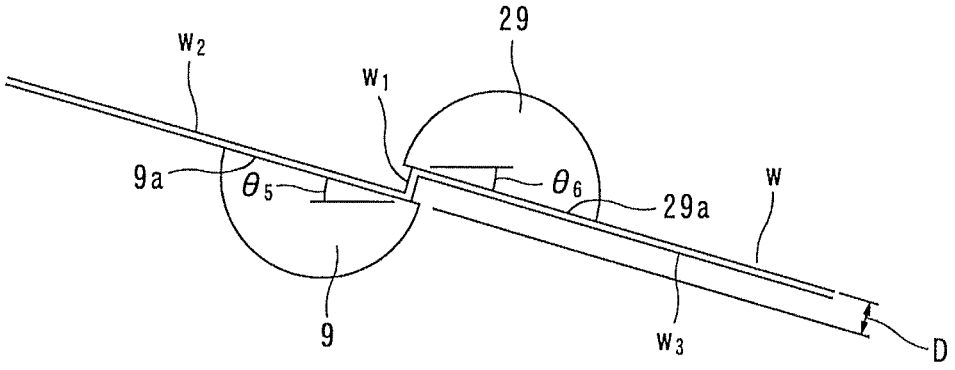
FIG. 7 is an explanatory diagram of a workpiece subjected to the step bending process in the step bending process (a third stage).

The semicircular rotary blades 9 and 29 are rotated in the clockwise direction within their own semicircular grooves 8 and 28 by reaction force against the pressing forces having different directions from the top portions 16 and 36. Then, both semicircular rotary blades 9 and 29 constantly press the workpiece W from the backward thereof. Namely, as shown in FIG. 7 in detail, the workpiece W is divided to three parts that are a stepped portion W1 which is made at right angle at the midpoint of the gap e between both top portions 16 and 36 and two left and right pieces W2 and W3 which is made on the both sides of the stepped portion W1, and the three parts are bent separately. Even in that case, since the semicircular rotary blades 9 and 29 are in contact with the whole surface of the workpiece W, their edges do not come in contact with the workpiece W. In addition, since the semicircular rotary blades 9 and 29 rotate in the clockwise direction within the semicircular grooves 8 and 28 respectively, the flat surfaces 9*a* and 29*a* thereof are always kept parallel. This means that angle θ5 of the left piece W2 and angle θ6 of the right piece W3 of the workpiece W are same angle, so that the left piece W2 and the right piece W3 are in parallel state. The step size D is obtained in proportion to the stroke amount of the punch 3 (amount of change in the relative position between the die 2 and the punch 3), and, for example, if the step size D of 2 mm is obtained when the thickness of the workpiece W is 1 mm, in the case of Applicant's installation press brake, the numerical values are SB 306, 99.

If the stroke amount of the press brake is controlled, the step size D can be obtained from about 1.5 mm to about 3.5 mm.

EXPLANATION OF LETTERS OR NUMERALS

1 step-bending die device
2 die
3 punch
5, 25 horizontal surface
6, 26 inclined surface
7 die base
8, 28 semicircular groove
9, 29 semicircular rotary blade
11, 31 tension spring for holding semicircular rotary blade
12, 32 rotation returning tension spring
15, 35 vertical notch
16, 36 top portion
39 adjuster plate

The invention claimed is:

1. A step-bending die device comprising:
a die; and
a punch,
wherein:
the step-bending die device is configured to form steps on a workpiece by changing relative positions of the die and the punch;
the die has:
a first horizontal surface and a first inclined surface;
a first semicircular groove with a first semicircular cross section defined along a first longitudinal direction on the first horizontal surface;
a first semicircular rotary blade having a first circular arc surface corresponding to the first semicircular groove and a first flat surface corresponding to the first horizontal surface, the first semicircular rotary blade being rotatable in the first semicircular groove;
a first top portion extending in the first longitudinal direction between the first horizontal surface and the first inclined surface; and
a first vertical notch in communication with the first top portion and the first semicircular groove;
the punch has:
a second horizontal surface facing the first inclined surface and a second inclined surface facing the first horizontal surface;
a second semicircular groove with a second semicircular cross section defined along a second longitudinal direction on the second horizontal surface;

a second semicircular rotary blade having a second circular arc surface corresponding to the second semicircular groove and a second flat surface corresponding to the second horizontal surface, the second semicircular rotary blade being rotatable in the second semicircular groove;

a second top portion extending in the second longitudinal direction between the second horizontal surface and the second inclined surface, the second top portion being offset from the first top portion; and a second vertical notch in communication with the second top portion and the second semicircular groove, and the first top portion is configured to enter the second vertical notch while bending the workpiece when the punch is moved toward the die, and at a same time, the second top portion is configured to enter the first vertical notch while bending the workpiece when the punch is moved toward the die, the first semicircular rotary blade is configured to rotate in the first semicircular groove such that the first flat surface keeps full contact with the workpiece during bending, and the second semicircular rotary blade is configured to rotate in the second semicircular groove such that the second flat surface keeps full contact with the workpiece during bending.

2. The step-bending die device according to claim 1, wherein the die and the punch are configured to change an interval between vertical lines along vertical portions of the first and second vertical notches by changing relative positions of the die and the punch in a left-right direction.

3. The step-bending die device according to claim 1, wherein:

an adjuster plate is fixed to the punch with a screw for regulating positions in a left-right direction;

the adjuster plate and the die are configured to receive the workpiece or a shim therebetween during bending; and a position of the die in the left-right direction is fixed to a die base.

4. The step-bending die device according to claim 1, further comprising:

a first tension spring for holding the first semicircular rotary blade for installing the first semicircular rotary blade in the first semicircular groove; and a second tension spring for holding the second semicircular rotary blade for installing the second semicircular rotary blade in the second semicircular groove.

5. The step-bending die device according to claim 1, further comprising:

a first tension return spring for returning the first semicircular rotary blade in a first direction; and a second tension return spring for returning the second semicircular rotary blade in a second direction.

6. The step-bending die device according to claim 1, wherein a step size is determined by an amount of change in relative positions of the die and the punch in a vertical direction.

7. The step-bending die device according to claim 2, wherein:

an adjuster plate is fixed to the punch with a screw for regulating positions in a left-right direction;

the adjuster plate and the die are configured to receive the workpiece or a shim therebetween during bending; and a position of the die in the left-right direction is fixed to a die base.

8. The step-bending die device according to claim 2, further comprising:

a first tension spring for holding the first semicircular rotary blade for installing the first semicircular rotary blade in the first semicircular groove; and a second tension spring for holding the second semicircular rotary blade for installing the second semicircular rotary blade in the second semicircular groove.

9. The step-bending die device according to claim 3, further comprising:

a first tension return spring for returning the first semicircular rotary blade in a first direction; and a second tension return spring for returning the second semicircular rotary blade in a second direction.

10. The step-bending die device according to claim 2, further comprising:

a first tension return spring for returning the first semicircular rotary blade in a first direction; and a second tension return spring for returning the second semicircular rotary blade in a second direction.

11. The step-bending die device according to claim 3, further comprising:

a first tension return spring for returning the first semicircular rotary blade in a first direction; and a second tension return spring for returning the second semicircular rotary blade in a second direction.

12. The step-bending die device according to claim 4, further comprising:

a first tension return spring for returning the first semicircular rotary blade in a first direction; and a second tension return spring for returning the second semicircular rotary blade in a second direction.

13. The step-bending die device according to claim 2, wherein a step size is determined by an amount of change in relative positions of the die and the punch in a vertical direction.

14. The step-bending die device according to claim 3, wherein a step size is determined by an amount of change in relative positions of the die and the punch in a vertical direction.

15. The step-bending die device according to claim 4, wherein a step size is determined by an amount of change in relative positions of the die and the punch in a vertical direction.

16. The step-bending die device according to claim 5, wherein a step size is determined by an amount of change in relative positions of the die and the punch in a vertical direction.

* * * * *